United States Patent [19]

Williams et al.

[11] 4,033,769

[45] July 5, 1977

[54] PERSISTENT PHOTOCONDUCTIVE COMPOSITIONS

[75] Inventors: David J. Williams, Fairport, N.Y.; Marcel A. Lardon, Trubach, SG, Switzerland; Martin A. Abkowitz; Gustav Pfister, both of Webster, N.Y.

[73] Assignee: Xerox Corporation, Stamford, Conn.

[22] Filed: Oct. 30, 1974

[21] Appl. No.: 519,329

Related U.S. Application Data

[62] Division of Ser. No. 316,152, Dec. 18, 1972, Pat. No. 3,879,201.

[52] U.S. Cl. ..... 96/1.5; 96/1.6

[51] Int. Cl.[2] ..... G03G 5/00

[58] Field of Search ..... 96/1.6, 1 R, 1.5 C

[56] References Cited

UNITED STATES PATENTS

| | | | |
|---|---|---|---|
| 3,740,218 | 6/1973 | Contois | 96/1.5 |
| 3,811,879 | 5/1974 | Montillier | 96/1.5 |

*Primary Examiner*—David Klein
*Assistant Examiner*—John L. Goodrow
*Attorney, Agent, or Firm*—James J. Ralabate; James Paul O'Sullivan; John H. Faro

[57] ABSTRACT

Photoconductive compositions comprising an organic photoconductive material, an activator capable of forming a charge transfer complex with the photoconductive material, and a protonic acid. Imaging members provided with an imaging layer prepared from the above composition are highly light sensitive, requiring only brief exposure times, and exhibit a photoinduced state of elevated conductivity which persists long after exposure to light is terminated. These compositions can be returned to their relatively insulative state by merely subjecting the imaging layer to heat in the dark, thereby erasing this photoinduced image pattern of elevated conductivity.

18 Claims, No Drawings

PERSISTENT PHOTOCONDUCTIVE COMPOSITIONS

This is a division of application Ser. No. 316,152, filed Dec. 18, 1972, now U.S. Pat. No. 3,879,201.

BACKGROUND OF THE INVENTION

1. Field of the Invention

This invention relates to a photoconductive composition, a imaging method, a imaging member and a method of elevating the level of conductivity of a photoconductive material. More specifically, the compositions of this invention exhibit a photoinduced state of elevated conductivity which persists long after exposure to light is terminated. This characteristic, hereinafter also referred to as "persistent conductivity", enables the utilization of such materials in imaging systems wherein the conductivity of the photoconductive imaging layer must persist for extended periods of time after imaging of said layer. Such materials are also useful in cyclic imaging systems, since the elevated state of conductivity which persists in these selectively illuminated areas can be readily thermally erased and the imaging layer thus restored to its previous uniformly insulative state.

2. Description of the Prior Art

The formation and development of images on the imaging surfaces of photoconductive materials by electrostatic means is well known. The best known of the commercial processes, more commonly known as xerography, involves forming a latent electrostatic image on an imaging surface of an imaging member by first uniformly electrostatically charging this imaging surface and then exposing this electrostatically charged surface to a light and shadow image. The light struck areas of the imaging surface are thus rendered conductive and the electrostatic charge selectively dissipated in these irradiated areas. After the photoconductor is exposed, the latent electrostatic image on this bearing surface is rendered visible by development with a finely divided colored electroscopic material, known in the art as "toner". This toner will be principally attracted to those areas on the image bearing surface which retain the electrostatic charge and thus render visible the latent image.

The developed image can then be read or permanently affixed to the photoconductor where the imaging surface is not to be reused. This latter practice is usually followed with respect to the binder type photoconductive films (e.g. ZnO) where the photoconductive imaging layer is also an integral part of the finished copy.

In so-called "plain paper" copying systems, the latent image can be developed on a reusable photoconductive surface or transferred to another surface, such as a sheet of paper, and thereafter developed. When the latent image is developed on a reusable photoconductive surface, it is subsequently transferred to another substrate and then permanently affixed thereto. Any one of a variety of well-known techniques can be used to permanently affix the toner image to the copy sheet, including overcoating with transparent films, and solvent or thermal fusion of the toner particles to the supportive substrate.

In the above plain paper copying system, the materials used in the photoconductive layer should preferably be capable of rapid switching from insulative to conductive to insulative state in order to permit cyclic use of the imaging surface. The failure of a material to return to its relatively insulative state prior to the succeeding charging sequence will result in a increase in the dark decay rate of the photoconductor. This phenomenon, commonly referred to in the art as fatigue, has in the past been avoided by the selection of photoconductive materials possessing rapid switching capacity. Typical of the materials suitable for use in such a rapidly cycling system include anthracene, sulfur, selenium and mixtures thereof (U.S. Pat. No. 2,297,691); selenium being preferred because of its superior photosensitivity.

Many materials which persist in their conductivity after illumination can also be satisfactorily used in electrophotography by simple revision of the imaging sequence. In such a revised imaging sequence, the uncharged imaging layer is initially exposed to light and shadow image and thus rendered persistently conductive in imagewise configuration in these light struck areas. After exposure, the imaged layer is electrostatically charged in the dark whereby an electrostatic charge pattern is formed on the non-conductive areas. This charge pattern can then be developed directly or transferred to another surface for development. Development can be performed by any of the standard techniques available to the art. Subsequent to transfer of the latent image from the imaging surface, the imaging layer is uniformly illuminated to dissipate any residual charge patern and then restored to its former insulative state by heating in the dark for a brief interval. The above imaging system is more comprehensively described in U.S. Pat. No. 3,545,969, which is hereby incorporated by way of reference.

Depending upon the level of such persistent conductivity, the imaging layer can be used for short term image storage similar to standard photographic films. Inorganic phosphors, such as zinc cadmium sulfide, have reportedly been used in such an imaging mode; however, due to only short lived persistence, have not received broad commercial acceptance in electrophotography. Other disadvantages frequently encountered in the use of such materials is their relative slow exposure speed and nonerasable photoinduced conductivity making them thus unsuitable for a rapid cyclic imaging process.

A number of organic photoconductive materials having persistent photoconductivity have also been disclosed in the patent literature (U.S. Pat. No. 3,113,022); however, these materials reportedly suffer many of the same inadequacies encountered in the use of the previously discussed inorganic compositions. A relatively recent reference (U.S. Pat. No. 3,512,966) reportedly discloses thermally erasable persistently conductive organic compositions suitable for use in electrophotography. This composition is prepared from a dispersion of a polymer, such as poly-N-vinylcarbazole, a dye and an activator selected from a group consisting essentially of specific carboxylic acids; carboxylic acid anhydrides; nitrophenols; and nitroanilines.

Although the above organic composition purportedly resolves many of the deficiencies heretofore present in the materials previously discussed, it still does not possess the speed and level of persistent conductivity requisite for use in an electrophotographic device where the recorded image is to be stored for periods of up to twenty-four hours prior to development.

It is, therefore, an object of this invention to remove this as well as other related deficiencies in the prior art.

A more specific object of this invention is to provide a novel photoconductive composition.

Still another of the objects of this invention is to provide a photoconductive composition capable of retention of a recorded image for extended periods of time.

A further object of this invention is to provide a photoconductive composition having both the sensitivity and image retention capacity to be suitable for use in an electrophotographic recording device.

A still further object to this invention includes the use of this photoconductive composition in an imaging method and a method of elevating the level of conductivity in organic photoconductive compositions.

SUMMARY OF THE INVENTION

The foregoing and related objects are accomplished by providing a photoconductive composition suitable for use in electrophotographic imaging which comprises an organic photoconductive material, an activator capable of formation of a charge transfer complex with said organic photoconductive material and a protonic acid. The acid component of the composition must be present in sufficient concentration relative to the activator to enhance the stability of a complex formed during illuminatin between the anion radical form of the activator and a proton. The stability of this protonated activator radical is believed determinative of the degree and duration of the photoinduced state of elevated conductivity of the photoconductive composition which persists subsequent to selective illumination. This photoconductive composition can be used as either a rapidly switching or persistent imaging layer depending upon the degree of exposure given to it and the acidity of the environment of the charge transfer complex. The preferred compositions of this invention have a strong tendency toward this elevated state of conductivity and can be restored to a relatively insulative condition by subjecting the imaged composition to heat, thereby erasing this conductive image pattern.

The invention also embraces electrostatographic imaging methods employing the above photoconductive composition, a imaging member comprisng an imaging layer of the above composition, and a method of enhancing the tendency of complexing species within such photoconductive compositions toward this elevated state of photoinduced conductivity.

DESCRIPTION OF THE INVENTION INCLUDING PREFERRED EMBODIMENTS

Organic photoconductive electron donor materials which can be used in preparation of the photoconductive compositions of the present invention include what can be termed "small molecule" photoconductors dispersed in an inert cohesive matrix and any of a number of the polymeric photoconductive materials.

These so-called "small molecule" photoconductive materials include the following: oxadiazoles; e.g., 2,5-bis[4'-diethylaminophenyl]-1,3,4-oxadiazole, 2,5-bis-[4'-propylamino)-2'-chlorophenyl-(1')]-1,3,4-oxadiazole, 2,5-bis-[4'-N-ethyl-N-n-propylaminophenyl-(1')]-1,3,4-oxadiazole, 2,5-bis-[4'-dimethylaminophenyl]-1,3,4-oxadiazole; triazoles, e.g., 1-methyl-2,5-bis-[4'-diethylaminophenyl]-1,3,4-triazole; imidazoles, e.g., 2-(4'-dimethylaminophenyl)-6-methoxy-benzimidazole; oxazoles, e.g. 2-(4'chlorophenyl)-phenanthreno-(9'-10':4,5)-oxazole; thiazoles, e.g., 2-(4'-diethylaminophenyl)-benzthiazole; thiophenes, e.g. 2,3,5-triphenylthiophene; triazines, e.g. 3-(4'-aminophenyl)-5,6-dipyridyl-(2')-1,2,4-triazine, 3-(4'-dimethylaminophenyl)-5,6-di(4'-phenoxyphenyl)-1,2,4-triazine; hydrazones, e.g. 4-dimethylaminobenzaldehyde isonicotinic acid hydrazone; styryl compounds, e.g. 2-(4'-dimethylaminostyryl)-6-methyl-4-pyridone, 2-(4'-dimethylaminostyryl)-5-(or 6)-amino-benzimidazole, bis (4-dimethylaminostyryl) ketone; azomethines, e.g. 4-dimethylaminobenzylidene-β-naphthylamine; acylhydrazones, e.g. 4-dimethylaminobenzylidenebenzhydrazine, 4-dimethylaminobenzylidene-4-hydroxybenzoic hydrazide, 4-dimethylaminobenzylidene-2-aminobenzoic hydrazide, 4-dimethylaminobenzylidene-4-methoxybenzoic hydrazide, 4-dimethylaminobenzylidene-iso-nicotinic hydrazide, 4-dimethylaminobenzylidene-2-methylbenzoic hydrazide; pyrazolines e.g. 1,3,5-triphenylpyrazoline, 1,3-diphenyl-5-[4'-methoxy-phenyl]-pyrazoline, 1,3-diphenyl-5[4'-dimethylaminophenyl[pyrazoline; 1,5-diphenyl-3-styrylpyrazoline; 1-phenyl-3[4'-dimethylaminostyryl]-5-[4'-dimethylaminophenyl]-pyrazoline; imidazolones, e.g. 4-[4'-dimethylaminophenyl]-5-phenylimidazolone, 4-furfuryl-5-phenylimidazolone; imidazolethiones, e.g. 4-[4'-dimethylaminophenyl]-5-phenylimidazolethione, 3,4,5-tetraphenylimidazolethione; 1,3,5-triphenyl-4-[4'-dimethylaminophenyl-]imidazolethione; 1,3,4-triphenyl-5-furfurylimidazolethione; benzimidazoles, e.g. 2-[4'-dimethylaminophenyl]-benzimidazole, 1-methyl-2-[4'-dimethylaminophenyl]-benzimidazole, 1-phenyl-2-[4'-dimethylaminophenyl]-benzimidazole; benzoxazoles, e.g. 2-[4'-dimethylaminophenyl]-benzoxazole; and benzothiazoles, e.g. 2-[4'-dimethylaminophenyl]-benzothiazole.

Materials which can be effectively used to provide the inert cohesive matrix for dispersion of the above small molecule photoconductors are polymers having fairly high dielectric strength and which are good electrically insulating film forming vehicles. Typical of such inert polymer matrices are: styrene-butadiene copolymers; silicone resins, styrene-alkyd resins; soya-alkyd resins; polyvinyl chloride; polyvinylidene chloride; vinylidene chloride-acrylonitrile copolymers; polyvinyl acetate; vinyl acetate-vinyl chloride copolymers; polyvinyl acetals, such as polyvinyl formal; polyacrylic and methacrylic esters, such as polymethyl methacrylate, poly-n-butyl methacrylate, polyisobutyl methacrylate; polystyrene; nitrated polystyrene; polymethylstyrene; isobutylene polymers; polyesters, such as polyethylene-alkaryloxyalkylene terephthalate; phenolformaldehyde resins; ketone resins; polyamide; and polycarbonates. Methods of making resins of this type have been described in the prior art, for example, styrene-alkyd resins can be prepared according to the method described in U.S. Pat. Nos. 2,361,019 and 2,258,423.

Typical polymeric photoconductive materials suitable for use in preparation of such photoconductive compositions include: poly-N-acrylylphenothiazone, poly-N-(β-acrylyloxyethyl)-phenothiazine, poly-N-(2-acrylyloxy propyl)-phenothiazine, polysllylcarbazole, poly-N-(2-acrylyoxy-2-methyl-N-ethyl) carbazole, poly-N-(2-p-vinylbenzoyl-ethyl)-carbazole, poly-N-propenylcarbazole, poly-N-vinyl-carbazole, poly-N-2-meth-acrylyloxypropyl carbazole, poly-N-acrylyl-carbazole, poly-(N-ethyl-3-vinylcarbazole), poly-4-vinylp-(-N-carbazyl)-toluene, poly (vinylanisal acetophenone), poly(vinylpyrene) and polyindenes.

If desired, the monomers of the polymeric photoconductors can be copolymerized with each other or with other monomers, such as vinyl acetate, methylacrylate, vinylcinnamate, polystyrene, 2-vinylpyridine.

The photoresponsiveness of the above photoconductive materials are enhanced with respect to speed and spectral response by the addition thereto of any of a number of standard activators (electron acceptors) and, optionally, any one of a number of dyestuff sensitizers. The quantity of activator in the photoconductive compositions will vary depending upon the level of enhancement of conductivity desired and the effect such inclusions have on the physical properties of the composition. Generally, the amount of activator present in the photoconductive composition will range from about 0.1 to 50.0 weight percent based upon the weight of the photoconductive material, with 1–6 weight percent ordinarily being preferred. The quantity of dyestuff sensitizer that can be optionally added to the composition is similarly limited. Representative of activators which can be added to these compositions include nitrobenzene, m-dinitrobenzene; o-dinitrobenzene; p-dinitrobenzene; 1-nitro-napthalene; 2-nitronapthalene; 2,5-dinitrophenapthrenequinone; 2,7-dinitrophenapthrenequinone; 3,6-dinitrophenapthrenequinone; 2,4 dinitrofluorene-$\Delta^{9,\alpha}$-malononitrile; 2,5 dinitrofluorene-$\Delta^{9,\alpha}$-malononitrile; 2,6 dinitrofluorene-$\Delta^{9,\alpha}$-malononitrile; 2,7 dinitrofluroene-$\Delta^{9,\alpha}$-malononitrile; 3,6 dinitrofluorene-$\Delta^{9,\alpha}$-malononitrile; 2,4,7 trinitrofluorene-$\Delta^{9,\alpha}$-malononitrile; 2,4,5,7 tetronitrofluorene-$\Delta^{9,\alpha}$-malononitrile; 2,4-dinitrofluorenone; 2,5-dinitrofluorenone; 2,6-dinitrofluorenone; 2,7-dinitrofluorenone; and 2,4,7-trinitro-9-fluorenone. Especially preferred activators of the type described above are the nitroaromatics. Examples of dyestuff sensitizers suitable for incorporation in the photoconductive compositions of this invention are the triarylmethane dyestuffs such as Malachite Green, Brilliant Green, Victoria Blue B, Methyl Violet, Crystal Violet, Acid Violet 6B; xanthene dyestuffs, namely rhodamines, such as Rhodamine B, Rhodamine 6G, Rhodamine G Extra, and Fast Acid Eosin G, as also phthaleins such as Eosin S, Eosin A, Erythrosin, Phloxin, Rose Bengal, and Fluorescein; thiazine dyestuffs such as Methylene Blue; acridine dyestuffs such as Acridine Yellow, Acridine Orange and Trypaflavine; and cyanine dyestuffs such as Pinacyanol, Cryptocyanine and Cyanine.

The protonic acids which can be used in extending the conductivity of the photoconductive compositions of this invention can by any proton donor having an aqueous dissociation constant of $10^{-4}$ and preferably greater. The upper concentration of acid relative to the photoconductive material is only limited by the solubility of such material in the photoconductive composition. Good results have been obtained utilizing as little as about 0.004 weight percent acid based upon the combined weight of the essential components of the photoconductive composition. In the preferred embodiments of this invention the acid concentration will range form about 0.1 – 4 weight percent.

Typical of the acids which can be used in the photoconductive compositions of this invention are: napthalinesulfonic acid, benzosulfonic acid, o-aminobenzosulfonic acid, p-aminobenzosulfonic acid, m-aminobenzosulfonic acid, iodoacetic acid, bromoacetic acid, dichloroacetic acid, trichloroacetic acid, dichloroacetylacetic acid, dimethylmalonic acid, dinicotinic acid, fluorobenzoic acid, o-hydroxybenzoic acid, lutidinic acid, maleic acid, malonic acid, oxalic acid, quinolinic acid $\alpha$-tartaric acid, phosphoric acid and sulfurous acid.

Both the essential and optional ingredients used in preparation of the herein disclosed photoconductive compositions are presently commercially available or can be prepared by well known chemical synthesis.

The photoconductive compositions of this invention can be prepared by dispersal of the above ingredients in their appropriate proportion in a suitable dispersal medium, forming a film of the dispersal on a conductive substrate and therafter evaporation of the dispersant. The liquid dispersal can be applied to the conductive substrate by any of a number of standard coating techniques. Film thickness is controlled by either adjustment of the viscosity of the dispersal or by mechanical means or both. The films thus produced form a substantially uniform, continuous and adherent coating on the conductive substrate. Ordinarily, an average film thickness of about 5 to about 50 microns will provide the conductive substrate with any imaging layer of the requisite insulative and photodischarge characteristics to be suitable for imaging in either xerographic or persistent imaging modes.

Liquid dispersal media suitable for use in preparation of coatings of these photoconductive compositions include benzene; toluene; acetone; 2-butanone; chlorinated hydrocarbons, e.g., methylene chloride, ethylene ethers, e.g. tetrahydrofuran, and mixtures thereof.

The substrate material bearing the above photoconductive film can be virtually almost any conductive, self-supporting material. Examples of such supporting materials include conductive paper; metals, e.g., copper, aluminum, zinc, tin, iron and lead; polyethylene terephthalate having a thin overcoating of aluminum and copper; and NESA glass. Under certain conditions, injection of carriers from the substrate into the overlying film will occur. This can be prevented by the interfacing of an insulative barrier layer between the photoconductive film and the substrate. The resistivity of this interfacial barrier should be about 1 to 10 megohms per square. Materials which are suitable in providing such a charge injection barrier include any of the traditionally used metal oxides and insulating polymeric resins.

Once the organic photoconductive composition is operatively associated with a conductive substrate, the resultant imaging member is ready for use in an electrostatographic imaging system. This imaging member can be used in the traditional xerographic mode of imaging where the imaging layer is charged and then exposed or a persistent imaging mode where exposure preceeds charging. In both types of imaging situations, the light struck areas of the imaging layer undergo photoinduced elevation of the level of conductivity in the illuminated areas, this conductivity persisting for a extended period subsequent to illumination. Where the imaging member is to be reused relatively soon after transfer of the latent or developed image from its imaging layer, the conductive image pattern in this layer must be erased, that is, the conductive areas restored to their relatively insulative state, prior to re-expousre to another light pattern. Erasure can be accomplished by first uniformly illuminating this imaging layer thus rendering it conductive in the previously non-illuminated areas and then heating said layer in the dark to a temperature in the range of about 50° to about 150° C for an interval sufficient to restore this layer to its former insulative state. The mechanics for achieving such erasure can comprise contacting the surface of the conductive imaging layer with a heated plate for the requisite interval or passing a heated roller over the surface of the imaging layer at a constant linear velocity; both plate and roller being within the prescribed temperature range.

The photoinduced processes associated with the light induced thermally erasable conductivity of the persistent photoconductive compositions prepared from the above ingredients were analyzed by standard electron spin resonance (esr) techniques. A photoinduced thermally erasable esr signal was observed in these materials. The intensity of this esr signal closely parallels the level of electrical conductivity of these photoconductive materials and varies with the temperature, duration and intensity of the light source. This esr signal is believed attributable to the reversible formation of a protonated anion radical of the activator and the electrical conductivity to the simultaneous formation of the mobile positive charge on the cation radical of the photoconductive material.

The Examples which follow further define, describe and illustrate preparation of a representative number of specific photoconductive compositions having the hereinbefore described physical properties. Imaging techniques and apparatus employed in such Examples, where not explicitly set forth, are presumed to be standard or as hereinbefore described. Example VIII has been included to provide a basis for comparison of a dyestuff sensitized photoconductive composition of a type previously disclosed in the literature with those compositions embraced within the scope of this invention.

EXAMPLE I

A photoconductive composition of the present invention is prepared from poly (N-vinylcarbozole), o-dinitrobenzene and trichloroacetic acid in the following manner: Ten grams of poly (N-vinylcarbazole) (molecular weight~300,00) are reprecipitated twice from a mixture containing equal parts of tetrahydrofuran (THF) and methanol for removal of impurities and the recovered polymer solids are then dissolved in sufficient THF to form a solution containing 15 weight percent of the polymer. o-dinitrobenzene is similarly purified by recrystallization from methanol and water. The o-dinitrobenzene and trichloroacetic acid (anhydrous solid) are then added to the polymer solution in sufficient quantities such that the relative weight ratio of the three components in solution is approximately 24 parts polymer:5 parts activator:0.5 parts acid. Once thoroughly mixed, the resulting solution is cast on an aluminum plate with the assistance of a doctor blade having a wet gap setting of 0.005 inches. The cured photoconductive film has an average thickness of about 10 microns. After the photoconductive composition is sufficiently cured, it is evaluated for use in a persistent imaging mode. This procedure involves initially heating the film to 100° C for 10 seconds in the dark, selectively masking the photoconductive surface, exposing the unmasked areas of the photoconductive surface with a 150 watt high intensity lamp (GE photoglood Model BBA) from a distance of 12 centimeters for 5 minutes thus forming a persistently conductive image pattern within the photoconductive layer. A dielectric sheet is then placed over the masked photoconductive layer and corona charged to a positive potential of 1100 volts. The dielectric sheet is then grounded, peeled from the masked photoconductive surface and developed with Xerox 813 toner (a thermoplastic styrene/n-butyl methacrylate copolymer containing a carbon black pigment). Ten additional copies are prepared from this persistently conductive imaging member in the manner described above without any reexposure of the masked photoconductive surface. Copy quality with respect to image intensity and resolution remain substantially unchanged from first through eleventh copy. Elapsed time for preparation of from the first to the eleventh copy is approximately 15 minutes.

EXAMPLE II

The procedure of Example I is repeated except that the dielectric sheet placed over the masked photoconductive layer is corona charged to a positive potential of 1450 volts. The dielectric sheet is peeled from the masked photoconductive surface and developed as described in Example I. Copy quality with respect to image intensity and resolution remains substantially unchanged from first through eleventh copy. Elapsed time for preparation of from the first to the eleventh copy is approximately 15 minutes.

EXAMPLE III

The procedure of Example I is repeated except that the dielectric sheet placed over the masked photoconductive layer is corona charged to a positive potential of 2000 volts. The dielectric sheet is peeled from the masked photoconductive surface and developed as described in Example I. Copy quality with respect to image intensity and resolution remains substantially unchanged from first through eleventh copy. Elapsed time for preparation of from the first to the eleventh copy is approximately 15 minutes.

Comparison of copy quality of Examples I–III indicates that image intensity varies directly with the potential generated by the corona discharge and, thus, the copies prepared in Example III proved to be superior.

EXAMPLE IV–VI

The procedue of Example I is repeated except for variation in the relative weight ratio of trichloroacetic acid to the polymer and activator.

| Example No. | Polymer: | Activator: | Acid |
|---|---|---|---|
| IV | 24 | 1 | 0.01 |
| V | 24 | 1 | 0.1 |
| VI | 24 | 1 | 1.0 |

In each of these Examples, two photoconductive films are cast from the solution of the above ingredients: one of these films being evaluated for used in a persistent imaging mode; and the other stripped from the aluminum substrate, and ground into a fine powder (~1–5 microns particle size).

The photoconductive imaging members are imaged and developed in the manner described in Example I. Image intensity and resolution appear to be of equivalent quality with respect to the first few copies; however, after eleven copies significant difference are evident in sharpness and image intensity in direct correlation with acid concentration of the persistently photoconductive film; image quality being superior at higher acid concentrations.

With respect to the powdered photoconductive samples, they are initially spread out on a thin layer on a glass plate, heated in the dark at 100° C for 1 minute, allowed to cool to room temperature (~23° C), and then illuminated with a 150 watt high intensity light source (GE Photoflood Model BBA) from a distance of 12 centimeters for a 5 minute period. Immediately subsequent to illumination, the powdered sample is packed into an esr tube having an outside diameter of 4 millimeters, the tube inserted into the dual cavity of a Varian X-band esr spectrometer operating at a modulation frequency of 6 KHz, and the sample esr spectrum recorded.

The following table shows signal intensity and the level of persistent conductivity for each of the three samples tested.

TABLE I

| Example No. | Relative esr Signal Intensity | Level of Persistent Conductivity in $(ohms)^{-1}$ |
|---|---|---|
| IV | 1 | $2.5 \times 10^{-8}$ |
| V | 3 | $8.3 \times 10^{-8}$ |
| VI | 10 | $2.5 \times 10^{-7}$ |

It thus appears that both the intensity of the esr signal and level of the persistent conductivity are proportional to the square root of the acid concentration, and the level of persistent conductivity and esr signal intensity proportional to one another.

EXAMPLE VII

In order to verify the role of the acid in the composition of this invention, the procedures followed in Examples IV–VI are repeated except for the omission of trichloroacetic acid from the composition. No elevated level of conductivity or esr signal is observed in these compositions.

EXAMPLE VIII

In order to evaluate the effect that dye sensitization has on the electrical properties of the photoconductive composition of this invention, two polymeric solutions are prepared, one from the composition of Example I and a second from the composition of Example I modified by the addition of 1 weight percent Malachite Green oxalate dye. Each film is cast on a conductive glass substrate (NESA Glass, Corning Glass, Corning, N.Y.). After curing of each of the films, a gold electrode is evaporated on a portion of the surface of each film and connected by means of a gold wire, anchored by a silver paste, to the ammeter which in turn is connected to the conductive substrate.

The photoresponsiveness of the dye sensitized and unsensitized photoconductive films are evaluated under identical conditions. In the initial phase of this evaluation, the films are heated in the dark to 100° C for 1 minute and then allowed to cool to room temperature (~23° C). Each sample is then separately illuminated by a 150 watt high intensity light source (GE Photoflood Model BBA), at a distance of 12 centimeters for 5 minutes, allowed to remain in a light tight enclosure for 5 minutes, and them restored to the level of conductivity formerly prevailing in the dark. This cycle of exposure, resting and erasure are repeated an additional 5 times. The conductivity in these films is continuously monitored before, during, and subsequent to each phase of this cycle.

The dye sensitized sample exhibits substantially enhanced conductivity in comparison to that of the unsensitized film during illumination, however, subsequent to illumination and after erasure the differences in the conductivity persisting in each of these films are functionally insignificant. Apparently, dye sensitization of the photoconductive composition of this invention does not result in appreciably more efficient utilization of incident light in the elevation of the level of conductivity of these materials; however, such dyestuff sensitizers do extend the range of spectral response of these photoconductive films thus accounting for greater response during illumination.

EXAMPLE IX

A photoconductive composition is prepared according to the procedues of Example VIII from poly (N-vinylcarbazole), 2,4,7-trinitro-9-fluorenone (TNF), and trichloroacetic acid; in the relative weight ratio of 24 parts polymer:1part activator:1 part acid.

The photoresponsiveness of this composition is evaluated in the manner described in Example IV–VI (esr spectra) and Example VIII (magnitude of photoinduced conductivity). The intensity of the esr signal is larger by a factor of three than the signal generated by illumination of the composition of Example VI; however, the dark decay rate with respect to the level of conductivity of the composition containing TNF is greater by a factor of 2 to 3 than the composition containing o-dinitrobenzene. Thus it appears that although higher levels of conductivity are more easily generated in the presence of TNF, that compositions containing o-dinitrobenzene are superior in terms of photoinduced conductivity persisting subsequent to irradiation.

EXAMPLE X–XIX

The following compositions are prepared in accordance with the procedures of Example I. The relative weight ratio of ingredients in each composition is 24 parts polymer:1 part activator:1 part acid.

| Ex. No. | Polymer | Activator | Acid |
|---|---|---|---|
| X | poly(N-vinylcarbazole) | o-dinitrobenzene | maleic acid |
| XI | poly(N-vinylcarbazole) | TNF | maleic acid |
| XII | poly(N-ethyl-3-vinyl-carbazole) | o-dinitrobenzene | trichloro-acetic acid |
| XIII | poly(N-ethyl-3-vinyl-carbazole) | TNF | trichloro-acetic acid |
| XIV | poly(N-ethyl-3-vinyl-carbazole) | o-dinitrobenzene | maleic acid |
| XV | poly(N-ethyl-3-vinyl-carbazole) | TNF | maleic acid |
| XVI | poly(vinylpyrene) | o-dinitrobenzene | trichloro-acetic acid |
| XVII | poly(vinylpyrene) | TNF | trichloro-acetic acid |
| XVIII | poly(vinylpyrene) | o-dinitrobenzene | maleic acid |
| XIX | poly(vinylpyrene) | TNF | maleic acid |

All of the photoconductive films prepared from the above compositions are useful in both xerographic and persistent modes of imaging and upon selective illumination exhibit a photoinduced state of elevated conductivity in these light struck areas which persists long after illumination ceases.

What is claimed is:

1. A photoconductive composition comprising an organic photoconductive electron donor material, an activator capable of formation of a charge transfer complex with said photoconductive material and a protonic acid having an aqueous dissociation constant of at least $10^{-4}$, said acid being present in sufficient concentration in relation to the activator to enhance the stability of a complex formed during illumination between the anion radical form of the activator and a proton and thus extend the elevated level of conductivity of the composition in these light struck areas subsequent to illumination.

2. The photoconductive composition of claim 1, wherein the activator is a nitroaromatic compound.

3. The photoconductive composition of claim 1, wherein the concentration of activator in said composition ranges from about 0.04 to about 4 weight percent based upon the combined weight of the essential components of said composition.

4. The photoconductive compositions of claim 1, wherein the protonic acid is trichloroacetic acid.

5. The photoconductive compositon of claim 1, wherein the photoconductor is a polymeric material.

6. The photoconductive composition of claim 5, wherein the photoconductive material in a polymer which comprises repeating structural units from N-vinyl-carbazole.

7. The photoconductive composition of claim 1, wherein the activator is o-dinitrobenzene.

8. The photoconductive composition of claim 1, wherein the activator is 2,4,7-trinitro-9-fluorenone.

9. The photoconductive composition of claim 1, wherein the photoconductive composition contains a 1:1 weight ratio of activator to protonic acid.

10. An imaging member comprising a coherent, adherent photoconductive imaging layer overlying at least one surface of a conductive substrate, said photoconductive imaging layer comprising an organic photoconductive electron donor material, an activator capable of forming a charge transfer complex with said photoconductive material and a protonic acid having an aqueous dissociation constant of at least $10^{-4}$, said acid being present in a sufficient concentration in relation to the activator to enhance the stability of a complex formed during illumination between the anion radical form of the activator and a proton and thus extend the elevated level of conductivity in these light struck areas subsequent to illumination.

11. The imaging member of claim 10, wherein the activator is a nitroaromatic compound.

12. The imaging member of claim 10, wherein the concentration of activator in said photoconductive layer ranges from about 0.04 to about 4 weight percent.

13. The imaging member of claim 10, wherein the photoconductive material is polymeric.

14. The imaging member of claim 10, wherein the photoconductive material comprises repeating structural units from N-vinyl-carbazole.

15. The imaging member of claim 10, wherein the activator is o-dinitrobenzene.

16. The imaging member of claim 10, wherein the activator is 2,4,7-trinitro-9-fluorenone.

17. The imaging member of claim 10, wherein the photoconductive layer contains a 1:1 weight ratio of activator to protonic acid.

18. The imaging member of claim 10, wherein the protonic acid is trichloroacetic acid.

* * * * *